United States Patent [19]

Grass

[11] 4,114,237

[45] Sep. 19, 1978

[54] DOOR HINGE

[76] Inventor: Alfred Grass, Konsumstrasse 492, A-6973 Hochst/Vlbg., Austria

[21] Appl. No.: 738,619

[22] Filed: Nov. 3, 1976

[30] Foreign Application Priority Data

Nov. 7, 1975 [AT] Austria ..... 8517/75

[51] Int. Cl.[2] ..... E05D 11/10

[52] U.S. Cl. ..... 16/145; 16/164

[58] Field of Search ..... 16/189, 145, 163, 164, 16/50, 180, 182, 183, 142

[56] References Cited

U.S. PATENT DOCUMENTS

| | | | |
|---|---|---|---|
| 3,590,420 | 7/1971 | Salice | 16/145 X |
| 3,744,086 | 7/1973 | Salice | 16/164 |
| 3,940,828 | 3/1976 | Lautenschlaeger | 16/163 |

FOREIGN PATENT DOCUMENTS

| | | | |
|---|---|---|---|
| 1,945,010 | 3/1971 | Fed. Rep. of Germany | 16/145 |
| 2,432,828 | 1/1975 | Fed. Rep. of Germany | 16/50 |
| 2,357,612 | 5/1975 | Fed. Rep. of Germany | 16/145 |
| 2,408,057 | 8/1975 | Fed. Rep. of Germany | 16/145 |
| 2,536,744 | 6/1976 | Fed. Rep. of Germany | 16/145 |

*Primary Examiner*—James Kee Chi

*Attorney, Agent, or Firm*—Bruce K. Thomas; Bruce K. Thomas; Bruce K. Thomas

[57] ABSTRACT

The invention relates to a door hinge comprising two hinge members one affixed to the door and the other to the door frame connected together by two jointing levers and a spring loaded roller engaging one of the levers, the mounting of the roller on the spring member symmetrically with respect to the longitudinal center line of the door hinge member to apply downward pressure on the hinge member of the door during closing when engaged by one of the levers.

11 Claims, 6 Drawing Figures

FIG. 4
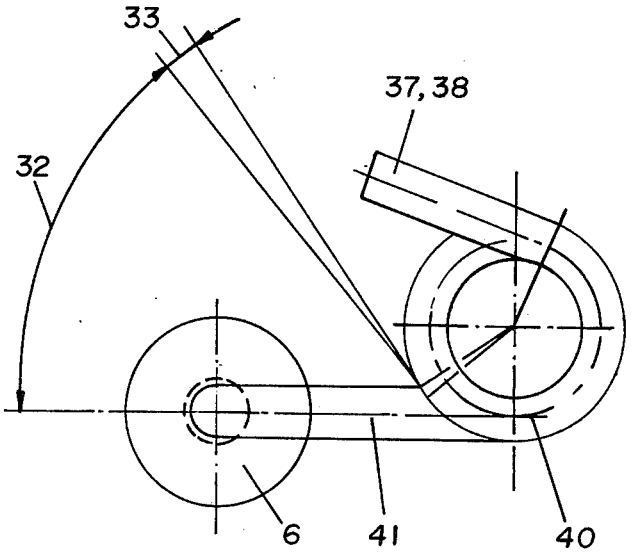
FIG. 5
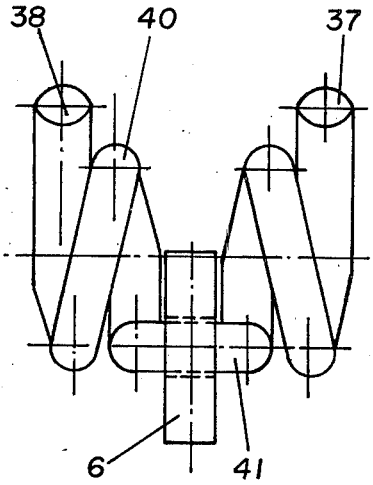
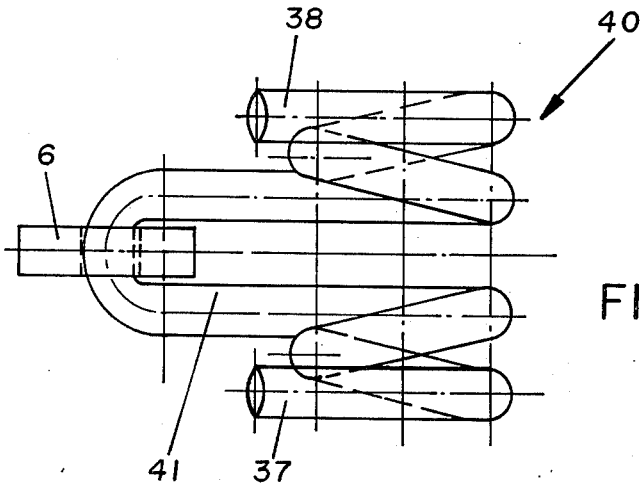
FIG. 6

DOOR HINGE

The present invention relates to a door hinge with closure pressure device formed from at least two hinge members connected by means of joint levers and at least one pressure member loaded by the force of a spring arm which pressure member rolls or slides on the periphery of at least one joint lever.

The problem of the invention is to improve the door hinge having a closure pressure device, which avoids any possible tilting of the pressure member, for example a roller due to an asymmetrical force of the pressure spring. The present invention has the further problem of further developing a door hinge such that the manufacturing costs can be lowered, in particular a slot for the guiding of the roller in the base of the stirrup of the stationary hinge member. The problem is solved so that the pressure member is mounted on a closed spring member of a spring which is mounted symmetrically to the longitudinal central axis of the hinge in the stationary hinge member.

With this arrangement a substantial increase of the life with an improvement at the same time of the operating safety is obtained. It is essential that the pressure member (this may be a roller, a slide or a coil of the spring itself) is employed. With this feature it is achieved that the pressure member is applied absolutely symmetrical by the force of the spring. In this way a closing force is obtained acting exclusively perpendicularly to the rolling plane of the joint lever. Any tilting is prevented by the symmetrical construction of the spring and by the symmetrical bearing of the pressure member; the life and operating certainty are substantially increased.

A further essential feature of the present invention is that the pressure member may, for example, be constructed as a roller. The displacement of the roller may be effected by suitable limitations imposed on the lengthened spring member on the spring. Such limitations on both sides of the roller may, for example, be produced by widening the closed spring member at these places in order to avoid the roller being capable of being removed.

The certainty of movement of the roller may however be effected by a slot in the base of the stirrup of the stationary hinge member through which the periphery of the roller partially projects.

Furthermore the closed spring member of the spring on which the pressure member is fixed may also be so formed that the spring coils themselves serve for the positioning of the pressure member.

Finally the pressure members may also be a slide block, a roller which is placed on the closed spring member or be formed by the closed spring member itself.

The invention will be described with reference to the accompanying drawings:

FIG. 4 is a detailed diagrammatic plan view showing spring of third embodiment.

FIG. 5 is a side view of a spring with a roller as shown in FIG. 4.

FIG. 6 shows a front view of the spring with the roller shown in FIGS. 4 & 5.

Figure 1:
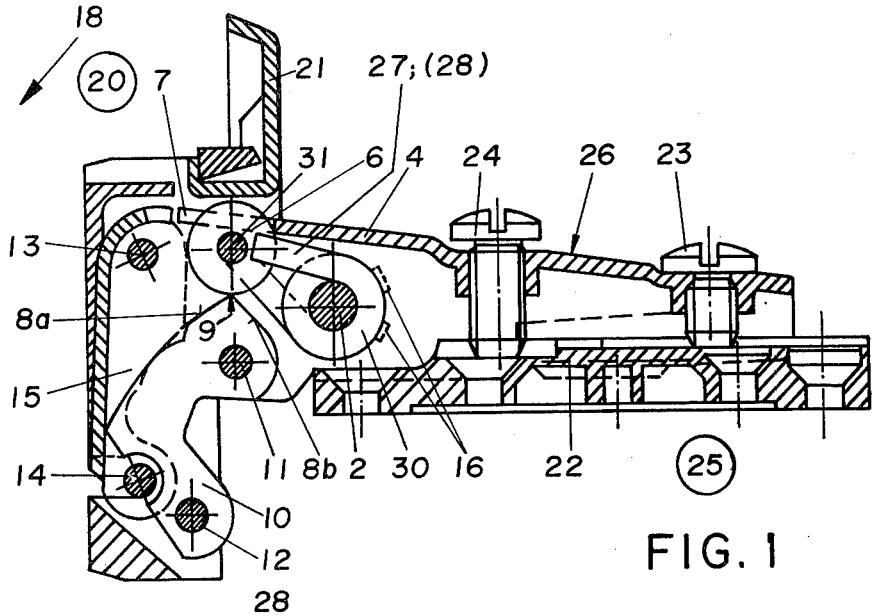
FIG. 1 shows a transverse sectional view of a door hinge with a closing pressure device according to the present invention.

In FIG. 1 is shown part of a door 20 movably connected to a stationary frame 25 through a door hinge having a top 21. The door hinge thus consists of the hinge top 21 inserted in the door and a stationary door frame hinge 26 which is fixed by means of a fixing screw 23 on a base plate 22 so that the base plate 22 is firmly secured on the frame 25 by fixing screws (not shown). The stationary frame hinge 26 contains the above described closing pressure device 6 which is described more precisely by the following description.

The hinge top 21 is pivotally connected to the stationary frame hinge 26 through two levers or link members 10 and 15. The link 15 is fixed to a bolt 14 on the hinge top 21 and to a bolt 13 on a stirrup 4 of the stationary frame hinge 26.

The base of the stirrup 4 is provided in with a slot 7 through which the pressure member, shown in the embodiment of FIG. 1 as a roller 6, projects partly for the purpose of lateral guidance. The closing pressure device is essentially formed by a coil spring 30 which is mounted on a pin 2 on the stirrup 4 and is supported by the legs 27, 28 on the stirrup 4 and by a lengthened spring member 31, defining a light portion (see FIG. 2) on which the pressure member, in the preceeding embodiment described, a roller 6 is mounted.

Figure 2:
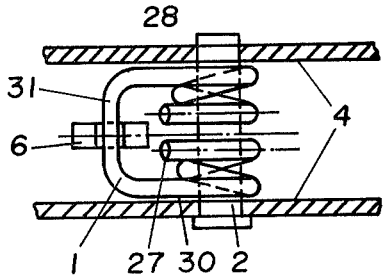
FIG. 2 is a detailed horizontal section of FIG. 1 showing the spring with fixing means and roller.

The representation of FIG. 1 shows the door hinge in the open position. In this position the roller 6 exerts a closing pressure on the hinge top 21 because of the off-set of the axis 31 in relation to the axis 11 indicated by the dead-center line 9. The roller 6 rolls on a part of the periphery of the joint lever 10 and is in the closing position just behind the over dead centre 9 on the flank **8*b* of the cam lobe of the joint lever 10. Upon opening the hinge top 21 in the direction of rotation 18 the pressure member (roller 6) passes over the dead centre 9 and reaches the flank 8*a* of the joint lever 10 lying tangentially of the bolt 11. In this position (open position) no closing pressure is produced. FIG. 2 shows the essential features of the present invention. The spring 30 is designed symmetrically about the longitudinal central axis of the door hinge. The free legs 27, 28 are supported on the viccinity of the centre of the spring on the base of the strirrup 4 and by the U shaped portion 31 of the spring 31. By means of the arrangement of the pressure member on the U shaped spring member 31 of the spring 30 gives an absolutely symmetrical loading of the pressure member 6. A rocking of the pressure member 6 on the flanks 8*a*, 8*b* of the joint lever 10 is now prevented. The embodiment according to FIG. 2 has the further advantage that the pressure member is disposed so as not to be detachable from the spring member 31 of the spring 30**.

In FIG. 1 it is shown that the spring 30 is mounted on the pin 2 in the stationary hinge frame 26 (more accurately: in the stirrup 4). Another means of fixing is drawn in broken lines. The spring 30 may also be positioned on the periphery by lugs 16 pressed out of the stirrup 4 the pin 2 being then omitted.

A further essential feature is that the free legs 27, 28 of the spring 30 are supported on the stationary hinge frame (stirrup 4). In this way, as in the known arrangement in which the free legs are supported on the movable hinge and overcome the fact that in known arrangements the closing force varies during the opening of the door hinge.

Another embodiment of the present invention provides for the free legs 27, 28 to be unsupported directly on the base of the stirrup 4 but into contact with a threaded bolt (adjusting screw) and the adjusting screw is located in a threaded bore in the base of the stirrup 4. By the adjustment of the adjusting screw a variation in the closing force within certain limits can be made.

Figure 3:
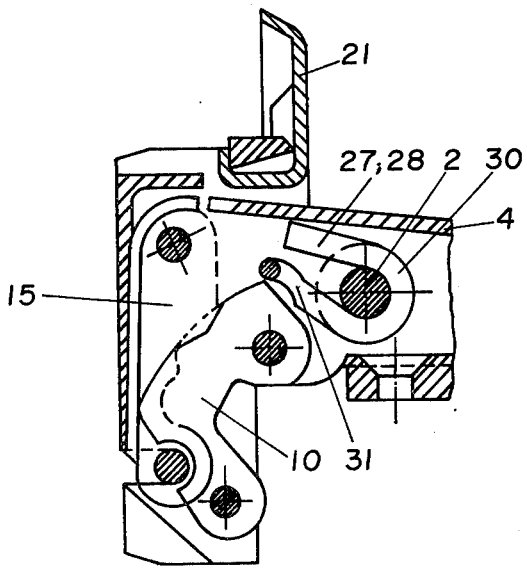
FIG. 3 is a part transverse section similar to FIG. 1 of a second embodiment showing another shape of the pressure member.

A further embodiment of the pressure member is shown in FIG. 3. Thus it can be seen that the roller 6 according to the embodiment., FIGS. 1 and 2 may be omitted; as a pressure member the bent spring member or light portion 31 of the spring 30 acts as a pressure member or can follower. This bent spring member 31 may for the reduction of friction also be coated with a plastic or have a sliding block which slides over the associated flanks 8*a*, 8*b* of the lever 10. The bending portion of the spring member 31 of the spring 30 may thus be shaped according to the constructional requirements. A third embodiment of a spring is shown in FIGS. 4, 5 and 6. From the representations it can be seen that the closed spring members 41 on which the pressure member is mounted extends from the centre of the spring 40 and the free legs 37, 38 are formed integrally with the springs 40. With this arrangement substantially advantages are achieved. First of all the pressure member (roller 6) is held so as not to be detachable from the closed spring member 41. Secondly the pressure member is centred by the side walls of the bent spring 41 so that a slot 7 according to the representation in FIG. 1 for centering the roller 6 on the part of the lever 10 can be omitted. This slot could also be omitted in the embodiment according to FIG. 3. In both cases the manufacturing costs of the door hinge according to the invention are reduced comparted with known arrangements.

In the embodiment according to FIGS. 4, 5, and 6 the roller 6 can be replaced by a sliding block or be completely omitted; in the latter case the front side of the closed spring member 41 exercises the closing pressure on the flanks 8*a*, 8*b* of the lever 10. In FIG. 5 the side view of a relieved spring 40 according to FIG. 4 is shown. The numeral 32 indicates the angle around which the closed spring member 41 is turned during the mounting in order to produce the necessary tension on the lever 10 for producing the closing force. The numeral 33 indicates the working angle by which the pressure member on the closed spring member 41 is moved during the overcoming of the over dead centre point 9 from the flank 8*b* to the flank 8*a*. This arrangement makes it clear that with the springs 30, 40 according to the invention, because of their symmetrical construction and high pretention provide a high closing force.

Similarly from FIG. 6 there follows the completely symmetrical construction of the spring 40. Thus it is essential for the bent closed spring member 41 is at the bottom in the direction of the flanks 8*a*, 8*b* of the joint lever 10 so that other parts of the spring 40 do not rub on the inwardly rotating joint lever 10.

What I claim is:

1. In an articulated hinge for a door including outer and inner link members each connecting between the door and the stationary frame by axially spaced pivot pins, the improvement comprising a resilient member interposed between the stationary frame and the innermost of said links, characterized in that said resilient member comprises:

a coiled spring member having an intermediate U-shaped extension projecting from oppositely wound co-axial convolutions, said convolutions terminating in outer free legs that extend toward and at an oblique angle to said U-shaped extension;

means supporting said coiled spring member on said stationary frame with said U-shaped extension contacting said innermost lever at a portion between its pivoted ends and thereby urging said innermost lever to a closed position of said door; and means supporting said free legs whereby said coil spring is biased with said U-shaped extension urged against said portion of said inner link member toward the closed position of said door.

2. A door hinge in accordance with claim 1 characterized in that said stationary frame includes opposing walls on each side of said coil spring member, said coiled spring member is mounted in the hinge by means of circumferentially spaced lugs bordering on the periphery of said convolutions, said lugs being pressed out of said opposed walls of said stationary frame.

3. An articulated hinge in accordance with claim 1 in which:

said intermediate portion of said inner link member defines a protruding cam surface associated with and radially spaced from its pivot pin on the stationary frame;

said cam surface having a crest portion that engages said extension in a plane off dead center of said pivot pin to impart a closing action on said hinge.

4. An articulated hinge in accordance with claim 3 in which:

said extension defines an axle extending parallel to and spaced from the axis of said coiled spring; and a roller member is included on said axle for engagement with said cam surface.

5. An articulated hinge in accordance with claim 4 including:

guide means defined by said stationary frame to align said roller member with said cam surface.

6. An articulated hinge for a door in accordance with claim 4 wherein:

said stationary frame includes a wall extending in substantially parallel relationship with and spaced from said axle defined by said extension; and a slot is provided in said wall to encompass said roller, the side edges of said slot guiding said roller member into straight-line relationship with said portion of said lever.

7. An articulated hinge for supporting a door from a stationary frame comprising, in combination:

an outer link member pivotally connected at its ends to said door and said stationary frame by a pair of pivots;

an inner link member pivotally connected at its ends to said door and said stationary frame by a second pair of pivots;

said inner link member having a radially projecting lobe cam surface about its innermost pivot;

a pivotally mounted arm member carried by said stationary frame with a roller cam follower at its extended end;

said arm member supporting said roller cam follower against axial movement and in operable relationship with said cam surface on said inner link member;

the plane of contact of said roller cam follower with said cam surface in the open position of said door being off dead-center on said lobe in relation to the rotating axis of said innermost pivot of said inner link member; and means arcuately and symmetrically biasing said arm member about its pivot mount with said roller cam follower against said cam surface whereby to urge both of said link members toward a closed position of said door.

8. An articulated hinge for supporting a door from a stationary frame comprising, in combination:

an outer link member pivotally connected at its ends to said door and said stationary frame by a pair of pivots;

an inner link member pivotally connected at its ends to said door and said stationary frame by a second pair of pivots;

said inner link member defining a cam lobe about its innermost pivot axis;

a resilient coiled spring member carried by its convolutions on a pivot axis by said stationary frame member;

said resilient coiled spring member defining a U-shaped extension projecting from said convolutions and a pair of free legs that extend to and in spaced biasing position against a portion of said stationary frame;

the bight portion of said U-shaped extension projecting into resilient contact with the cam lobe of said inner link member; and the plane of contact of said bight portion with said cam lobe at its furthest projection in the open position of said door being in a plane off dead-center in relation to the rotating axis of said innermost end of said inner link member whereby to urge both of said link members toward a closed position of said door.

9. An articulated hinge in accordance with claim 7 in which:

a roller cam follower is rotatably mounted on the bight portion of said U-shaped extension for contact with said cam lobe.

10. An articulated hinge in accordance with claim 8 in which:

said resilient coiled spring member includes a pair of oppositely wound convolutions terminating in inner free legs, said U-shaped extension depends from the respective outer ends of said convolutions and said free legs extend in substantially coplanar relationship into biasing contact with said supporting frame whereby said U-shaped extension is uniformly and symmetrically biased into contact with said cam lobe.

11. An articulated hinge in accordance with claim 8 in which:

said resilient coiled spring member includes a pair of oppositely wound convolutions terminating in free legs at the outer ends thereof, said U-shaped extension depends from the inner portion of said convolutions and said free legs extend in substantially parallel coplanar relationship into biasing contact with said supporting frame.

* * * * *